US007077067B2

(12) United States Patent
Bodde et al.

(10) Patent No.: US 7,077,067 B2
(45) Date of Patent: Jul. 18, 2006

(54) ADJUSTABLE HOLD-DOWN ASSEMBLY

(75) Inventors: George N. Bodde, Lexington, KY (US); Cindy G. Severs, Georgetown, KY (US)

(73) Assignee: Toyota Motor Manufacturing North America, Inc., Erlanger, KY (US)

( * ) Notice: Subject to any disclaimer, the term of this patent is extended or adjusted under 35 U.S.C. 154(b) by 316 days.

(21) Appl. No.: 10/201,802

(22) Filed: Jul. 24, 2002

(65) Prior Publication Data

US 2004/0016373 A1 Jan. 29, 2004

(51) Int. Cl.
*B65D 19/44* (2006.01)

(52) U.S. Cl. ..... 108/55.1

(58) Field of Classification Search ..... 108/51.11, 108/55.1, 53.3, 55.5; 706/386, 598, 595, 706/596; 240/346.02
See application file for complete search history.

(56) References Cited

U.S. PATENT DOCUMENTS 2,523,271 A * 9/1950 Bartel ..... 108/55.3
2,956,763 A * 10/1960 D Arca ..... 108/53.1
3,168,060 A * 2/1965 Farley ..... 108/53.5
4,186,667 A 2/1980 Seabrook
4,240,359 A * 12/1980 Howe ..... 108/53.1
4,349,302 A 9/1982 Ferguson, Jr.
4,355,732 A * 10/1982 Nessfield ..... 108/55.3
4,917,557 A * 4/1990 Kato et al. ..... 108/53.1
4,978,097 A 12/1990 Froutzis
5,101,964 A 4/1992 Westphal
5,257,896 A * 11/1993 Hastings ..... 108/53.1
5,404,821 A * 4/1995 Bond ..... 108/55.1
5,439,152 A * 8/1995 Campbell ..... 108/55.1
5,497,708 A 3/1996 Jeruzal
5,529,185 A 6/1996 Alspach et al.
5,575,389 A 11/1996 Alspach et al.
5,810,186 A * 9/1998 Lam ..... 108/55.1
5,894,803 A 4/1999 Kuga
6,227,397 B1 * 5/2001 Kim ..... 220/1.5
6,293,398 B1 9/2001 Grigsby, Jr.
6,474,245 B1 * 11/2002 Richard ..... 108/54.1

FOREIGN PATENT DOCUMENTS

FR 2683794 A1 * 5/1993

* cited by examiner

*Primary Examiner*—Jose V. Chen
(74) *Attorney, Agent, or Firm*—Dinsmore & Shohl LLP

(57) ABSTRACT

The present invention relates to an adjustable hold-down assembly for securely holding heavy and/or bulky goods such as automobile seats to a shipping pallet for transportation thereof. The shipping pallet has a base and a hold-down assembly and which has a cross-bar positioned between two securing posts that are movably attached to the base. The cross-bar is configured for rotational movement relative to the base and linear movement with respect to the securing posts.

19 Claims, 3 Drawing Sheets

ADJUSTABLE HOLD-DOWN ASSEMBLY

FIELD OF THE INVENTION

The present invention relates to a hold-down assembly for a shipping pallet, and more particular to an adjustable hold-down assembly for securely holding goods such as automobile seats to a shipping pallet for transportation thereof.

BACKGROUND OF THE INVENTION

Bulky, oddly-shaped and/or heavy durable goods such as automobile seats have been transported through interstate commerce and through a variety of assembly lines using shipping boxes or pallets with a variety of attachment mechanisms to secure the goods in place on the pallet. For example, several well known attachment mechanisms include bungee cords, straps, clips, plastic bags or wraps or combinations thereof. While such attachment mechanisms have been used for securing such items to a pallet there are often times significant drawbacks to their use.

One drawback associated with traditional attachment mechanisms is that often times attachment mechanisms such as straps or cords provide a safety risk because they are susceptible to getting tangled, broken or getting caught in a moving assembly line. Moreover, straps and cords, if they are not securely fastened to the pallet, must be collected and stored separately from the pallets where they can get lost, mixed up, or separated from other like devices. In these circumstances, the straps or cords are cumbersome and easily entangleable and generally add inefficiency to the manufacturing process. Accordingly, it would be advantageous to provide an attachment mechanism that was securely attached to a pallet to prevent the attachment mechanism from becoming entangled in a moving assembly line. Moreover, it would be advantageous to eliminate inefficiencies associated with having to maintain the attachment mechanism separate from the pallet, and to provide an attachment mechanism that was always available and adaptable to a variety of goods.

Another problem associated with shipping heavy, variably sized or shaped, and/or bulky goods is that often times one attachment mechanism is insufficient to securely attach the goods to the pallet. In these circumstances, the attachment mechanism might be designed to secure a particular item, but because of insufficient design, bungee cords or rope may also be used to ensure the item is secure. Accordingly, it would be advantageous to provide an attachment mechanism that securely held the goods in place on the pallet without having to resort to combining multiple attachments mechanisms for securing the goods.

Finally, most attachment mechanisms require more than one manual step to secure or release the goods to the pallet. In fact, most attachment mechanisms are complicated or cumbersome to the point of slowing production in an assembly line as assemblers may struggle to secure or release the goods in a timely fashion. Accordingly, it would be advantageous to provide an attachment mechanism that secured or released the goods in a single step or a continuous motion and could be done so without causing a bottle neck in the assembly process.

SUMMARY OF THE INVENTION

One embodiment of the present invention features a shipping pallet that comprises a base and a hold-down assembly. In such an embodiment, the hold-down assembly comprises a cross-bar positioned between two securing posts that are movably attached to the base. The cross-bar is configured for rotational movement relative to the base and linear movement with respect to the securing posts.

Another embodiment of the invention includes a shipping pallet that similarly comprises a base and a hold-down assembly. In this embodiment, the hold-down assembly has a load position where items can be placed on the base or removed therefrom, and an engaged position where the hold-down assembly secures one or more items relative to the base, and wherein the hold-down assembly can be moved from the load position to the engaged position with a continuous motion.

Another embodiment of the invention is a method unloading a shipping pallet. The method comprises the steps of providing a shipping pallet having a base and a hold-down assembly, applying an outward linear force on the hold-down assembly, and rotating the hold-down assembly from an engaged position to a load position with a continuous motion.

Objects, advantages and novel features of the present invention will become apparent to those skilled in the art from the following detailed description, which simply illustrates, various exemplary modes contemplated for carrying out the invention. As will be realized, the invention is capable of other different aspects all without departing from the invention. Accordingly, the drawings and descriptions are illustrative in nature and not restrictive.

BRIEF DESCRIPTION OF THE DRAWINGS

While the specification concludes with claims particularly pointing out and distinctly claiming the present invention, it is believed that the same will be better understood from the following description, taken in conjunction with the accompanying drawings, in which:

DETAILED DESCRIPTION OF EXEMPLARY EMBODIMENTS

Reference will now be made in detail to various embodiments of the invention, various examples of which are illustrated in the accompanying drawings, wherein like numerals indicate corresponding elements throughout the views.

Figure 1:
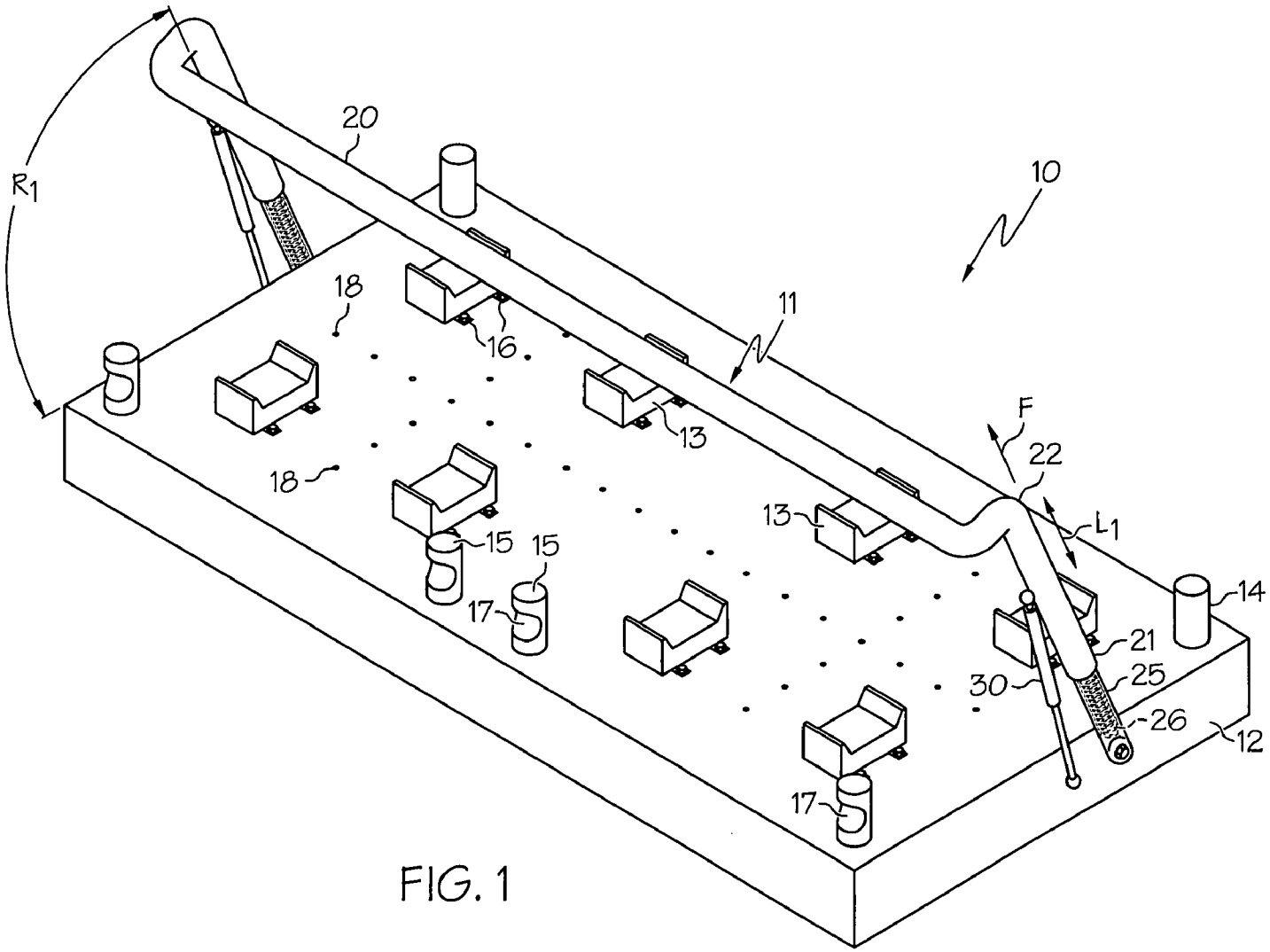
FIG. 1 depicts a perspective view of an exemplary embodiment of a shipping pallet in accordance with one embodiment of the present invention.
Figure 2:
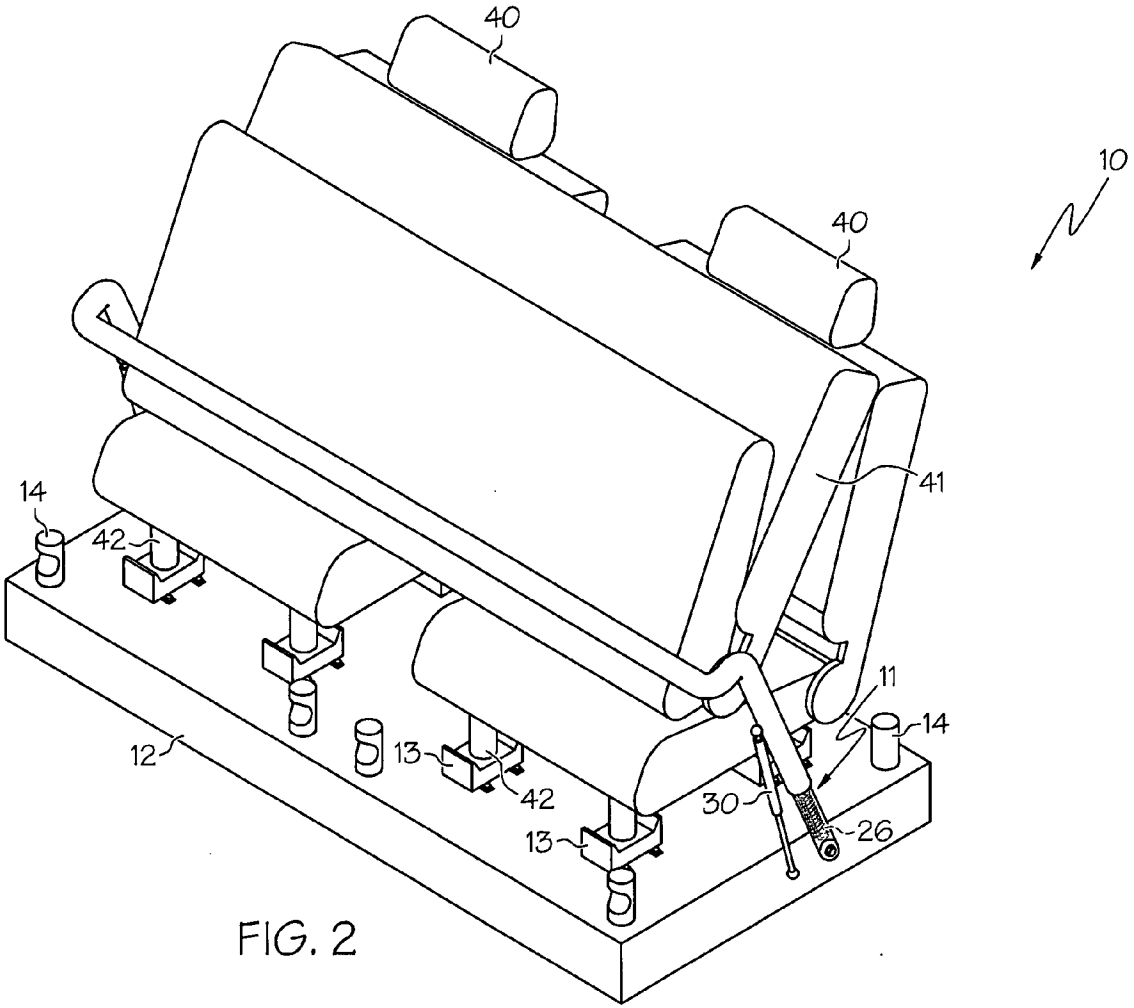
FIG. 2 depicts the exemplary perspective view of FIG. 1 further illustrating goods securely held in place on the shipping pallet.

FIGS. 1 and 2 depict an exemplary embodiment of a shipping pallet 10 comprising a hold-down assembly 11 and a base 12. While the hold-down assembly 11 could be used to secure virtually any type of item or good to the base 12 of the pallet 10, in an exemplary embodiment of the invention, the hold-down assembly 11 might be used to secure automobile seats to the base 12. In particular, the shipping pallet 10 is configured to hold one or more items such as seats (40, 41) of a passenger car or other vehicle, and provide for the secure and undamaged transportation of the seats from the manufacturer to an assembly line via traditional shipping sources such as truck, train or other common transportation medium. Moreover, the shipping pallet 10 can be configured to cooperate with almost any type of assembly line to allow the goods or seats secured to the base 12 to be delivered from the transportation medium to a convenient point on the assembly line without having to unload or re-load the pallet.

As illustrated in FIG. 1, the shipping pallet 10 comprises a base 12, which could, be of virtually any size or shape, but is contemplated to be designed to accommodate the type and number of goods being shipped. For example, in the vehicle seat example, the base 12 of the shipping pallet 10 of FIG. 1 might be rectangular to accommodate one or more seats of an automobile or minivan. For example, two captains chairs or bucket seats 40 and a bench seat 41 might be held secure and shipped on a single pallet as shown in FIG. 2. The two captains chairs 40 may rest in an upright position on the pallet and the bench seat 41 may rest on the seats of the two captains chairs, essentially in a stacked arrangement. For durability and reusability purposes, the base 12 of the shipping pallet is contemplated to be made from a durable plastic, metal, wood, or other relatively strong material.

In an exemplary embodiment of the invention, the base 12 might further comprise one or more interchangeable nests 13 configured to provide support and/or help secure a portion of the goods to the base 12. For example, in the seat example, the base 12 might be adapted to support and/or secure portions of automobile seats via nests 13. The nests 13 are adapted to receive a portion of the automobile seat, such as a seat post 42, in order to support and/or secure the automobile seats to base 12 of the shipping pallet 10. In this embodiment, the nests 13 would be located so as to help prevent the seats from inadvertently sliding, shifting or otherwise failing off the pallet during transportation, and to compliment and work together with the hold-down assembly, as will be deserved in detail below.

In this regard, the nests 13 may be designed to support and/or secure the posts 42 of the seat to the base 12 of the pallet 10. In one embodiment of the invention, the nests 13 might be adapted to engage, lock, securely hold, or otherwise impede undesired movement of the posts 42 of the automobile seats with respect to the base 12. In an alternate embodiment, the posts 42 may rest in a cooperating portion of the nests, such that the posts are prevented from sliding, shifting or otherwise falling off the shipping pallet 10 when the hold-down assembly is engaged, as will be discussed.

In an exemplary embodiment of the invention, the nests 13 are moveable, removable and replaceable or interchangeable with respect to the base 12. The nests are configured to be bolted with mounting bolts 16 or the like to the base 12, such as via apertures 18, which allows the nests to be moveable, removable and replaceable. In one embodiment of the invention, the nests 13 are removable and replaceable to allow for broken or other defective nests to be replaced without replacing the entire pallet. In another embodiment of the invention, the nests 13 are removable and replaceable to facilitate different setups of the pallet assembly to accommodate for the transportation and support of various types of seats for various types of cars. For example, if an automobile manufacturing facility manufactures more than one model of automobile within the manufacturing facility, the shipping pallets 10 can be configured to accommodate the various types of seats for the various types of cars, trucks, or the like by using different nests configured to accommodate for the various seat posts.

As mentioned, the base 12 may comprise a plurality apertures 18 or similar mounting arrangements positioned about the surface area of the base 12 to receive the mounting bolts 16. The apertures may be positioned at various locations on the pallet to provide flexibility in attaching the nests 13 to the base of pallet for accommodating various seat post designs and arrangements. As one of skill in the art should recognize, the nests 13 could be removably attached to the base in any other number of ways including clamps, pegs, latches or the like.

In an exemplary embodiment of the invention, the base 12 might further comprise one or more stacking posts 14 positioned around the periphery of the base for, among other things, providing for convenient stacking of the shipping pallets 10 for transportation to other facilities, such as the seat manufacturing facilities, or for storage or handling. In particular, as will be further described, in a load position as depicted in FIG. 4, the stacking posts 14 might be configured to extend a predetermined distance above any other component of the shipping pallet 10 to allow for easy stackability of the pallets. As one of skill in the art should recognize, the underside of the base 12 may comprise one or more cavities 19 (shown as dashed lines in FIGS. 3 and 4) or corresponding stacking elements for interfacing with or receiving the stacking posts 14. The cavities might also be adapted to allow for uniform and appropriately spaced stackability of each of the pallets. Accordingly, numerous shipping pallets 10 can be stacked for transportation, storage or handling, as appropriate.

The shipping pallet 10 of FIG. 1 is further illustrated as comprising a hold-down assembly 11 for securing goods, such as automobile seats (40, 41), to the base 12 of the pallet. In an exemplary embodiment of the invention, the hold-down assembly comprises a cross-bar 20 and two substantially parallel engagement portions 21 positioned at both ends of the cross-bar 20. As illustrated in FIG. 1, the engagement portions 21 of the hold-down assembly might desirably be configured to be substantially perpendicular to the cross-bar 20. While it should be recognized that the cross-bar could be of virtually any size and/or shape, in an exemplary embodiment of the invention, the cross-bar 20 has a length substantially equal to that of the length of the base 12. Moreover, the shape of the cross-bar 20 could be designed to take any shape that cooperates with the items or goods to be secured on the pallet. Additionally, as will be appreciated, the engagement portions 21 should be of sufficient size and shape as to accommodate one or more automobile seats individually or in a stacked arrangement.

In an exemplary embodiment of the invention, the cross-bar 20 and engagement portions 21 are designed as an integral unit, although they could be separate components that might be attached together in any variety of ways. Additionally, as further illustrated in FIG. 1, arches 22 may further be defined at each end of the cross-bar 20 between the end of the cross-bar 20 and the engagement portions 21. In this embodiment, the arches 22 curve downwardly from the apex of the engagement portions 21 to allow the cross-bar 20 to rest adjacent to the edge of the pallet for unencumbered loading and unloading of the pallet when the pallet is in a load position (e.g. FIG. 4). Once again, for durability and reusability purposes, the hold-down assembly 11 is contemplated to be advantageously made from a material such as metal, plastic, or wood.

In an exemplary embodiment of the invention, the securing posts 25 are pivotally attached to the base 12, such that the securing posts 25 are rotatably movable with respect to the base. In this example, the securing posts 25 might comprise hollow tubular structures, or telescoping tubes, that are configured to receive the engagement portions 21 of the hold-down assembly 11. Accordingly, here each engagement portion 21 of the hold-down assembly 11 would be configured to cooperate with and engage each of the securing posts 25 such that the hold-down assembly 11, including the cross-bar 20, is rotatably movable with respect to the base 12 (as indicated by arrow $R_1$).

A tension mechanism 26, such as a tension spring, may be positioned within the hollow tubular portion of the securing post 25 and adapted to allow the engagement portion 21 to move relative to the securing posts 25. In other words, each engagement portion 21 of the hold-down assembly 11 of this particular example would be configured to slideably engage each of the securing posts 25. In more detail, the tension mechanism 26 may be positioned between the securing post 25 (or base) and the engagement portion 21 of the hold-down assembly 11 such that the tension spring has one end fixedly attached to the securing post 25 and the other end fixedly attached to the engagement portion 21. As should be recognized, with such an arrangement, the force of the tension mechanism 26 tends to pull and hold the engagement portions 21 and cross-bar 20 inwardly toward the base 10. As such, the hold-down assembly 11, including the cross-bar is linearly displaceable (as illustrated by arrows $L_1$) with respect to the securing posts 25. As should be also recognized, a manual force "F" asserted by a user on the cross-bar 20 in the opposite direction of the securing posts 25 (or outward from the securing posts) allows the cross-bar 20 to move away from the securing posts 25.

It is contemplated that the hold-down assembly 11 of the present invention may further comprise a compression mechanism 30. As shown in the figures, one end of a compression mechanism 30 may be pivotally attached to the base 12 and the other end pivotally attached to the engagement portion 21 of the hold-down assembly 11 such that the compression mechanism 30 is also configured to be rotatably movable with respect to the base 12. The compression mechanism may comprise a spring such as a compression spring or, in an exemplary embodiment of the invention a pneumatic shock absorber. While the exemplary embodiment contemplates the use of a pneumatic shock absorber, the use of other mechanisms or arrangements capable of providing an appropriate damping effect to reduce and smooth out erratic movements of cross-bar 20 relative to base 12 may also be used. In this embodiment, a pneumatic absorber is contemplated, rather than simply a compression spring, to accommodate and absorb turbulence associated with movement during transportation. For example, a pneumatic absorber may help dampen the effects of sudden movement associated with transportation via truck or train. The dampening effect helps the hold-down assembly 11 maintain a constant or uniform clamping or hold down force to the goods for optimally secure transportation thereof.

Figure 3:
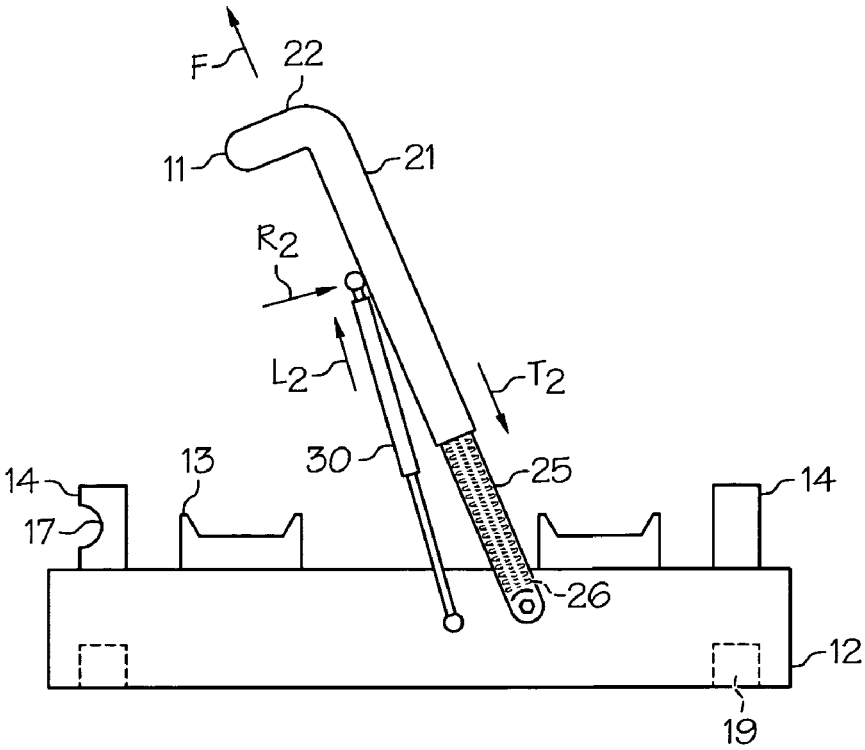
FIG. 3 depicts a side elevational view of the shipping pallet illustrated in FIG. 1, with the shipping pallet being shown in an engaged position.
Figure 4:
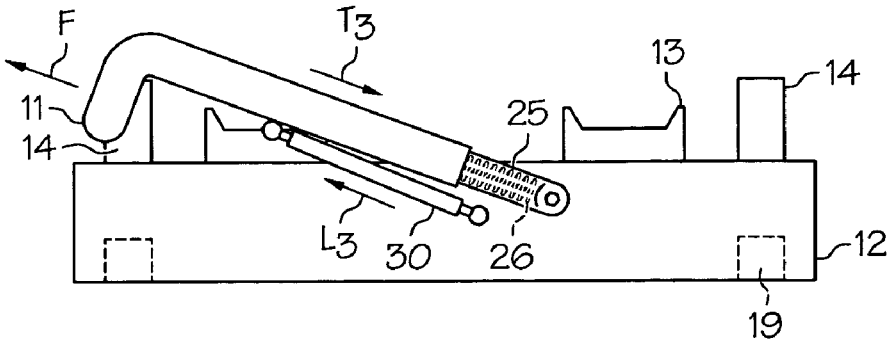
FIG. 4 depicts a side elevational view of the exemplary embodiment of the shipping pallet illustrated in FIG. 1, with the shipping pallet being shown in a load position.

As illustrated in FIGS. 3 and 4, the hold-down assembly 11 is configured to have at least two positions: an engaged position (FIG. 3) and a load position (FIG. 4). In the engaged position, the cross-bar 20 is adapted to apply one or more forces via the tension and/or compression mechanisms on the goods positioned on the shipping pallet 10 and hold the goods in a secure position for transportation thereof. In the load position, the cross-bar 20 is securely held in place via the tension mechanism adjacent the base 12 to allow the pallet to be stacked and stored or to allow for substantially unencumbered loading or unloading of the pallet.

In the engaged position illustrated in FIG. 3, the cross-bar 20 asserts one or more forces on the goods to securely hold the goods in place on the base 12. In this embodiment, the tension mechanism 26 applies a force on the cross-bar 20 as indicated by "$T_2$", which pulls the cross bar 20 toward the base. The compression mechanism 30 applies two forces on the cross bar 20: a force "$L_2$" and a force "$R_2$". Here, since the compression mechanism 30 is offset, or lies in a different axis from the tension mechanism 26, the force "$L_2$" from the compression mechanism 30 acts to linearly displace the engagement portion 21 outward from the securing posts 25, in opposition to the tensioning mechanism 26, while the force "$R_2$" from the compression mechanism 30 acts to rotatably displace the engagement portion 21 around the pivot of the securing posts 25 in a clock-wise direction.

As should be recognized, the force "$T_2$" of the tension mechanism 26 is greater than the offsetting linear displacement force "$L_2$" associated with the compression mechanism 30, so the cross-bar 20 tends to be pulled toward the securing posts 25 or toward the base 12. In this regard, the cross-bar, in the engagement position securely holds the goods such as automobile seats to the base 12. In the vehicle seat example, the force asserted by the cross-bar on the goods might be approximately 15 kg. Put another way, the manual force "F" required to manually linearly displace the cross-bar 20 out away from the goods should be approximately 15 kg.

FIG. 4 depicts the hold-down assembly 10 in a load or unengaged position. In this position, the cross-bar 20 of the hold-down assembly 11 engages one or more projections 15 and/or one or more receiving posts 14 positioned around the perimeter of the pallet (as best illustrated in FIG. 1). Here, it is contemplated that the base 12 might further comprise one or more projections 15 configured to engage a portion of the hold-down assembly 11 when the hold down assembly is in the load position. Each projection 15, as well as some of the receiving posts 14 may further comprise a notch 17 (as best seen in FIG. 3) having a shape that is similar to the outer-surface of the cross-bar 20 and configured receive and/or otherwise to cooperate with the crossbar 20. In this position, the cross bar 20 is adapted to engage one or more of the notches 17 on the receiving posts 14 and/or projections 15 such that the cross-bar is securely held in place adjacent the base 12 to allow the pallet to be stacked and stored or to allow for unencumbered loading of the pallet.

In the load position, both the tension mechanism 26 and the compression mechanism 30 apply a force on the cross-bar 20 as indicated by "$T_3$" and "$L_3$" respectively in FIG. 3. In this position, the compression mechanism 30 lies in substantially the same axis as the tension mechanism 26 positioned in the tubular securing post 25 of the hold-down assembly. In effect, the tension mechanism 26 provides a pulling force "$T_3$" on the engagement portion 21 and tends to cause the cross-bar to be pulled toward the securing posts 25. The compression mechanism 30 acts in opposition to the tensioning mechanism 26 to tend to linearly displace the engagement portion 21 outwardly from the securing posts 25 as indicated by force "$L_3$". As should be recognized, the force "$T_3$" of tension mechanism 26 is greater than the offsetting linear displacement force "$L_3$" associated with the compression mechanism 30, so that the cross-bar 20 tends to be pulled toward and engage with the notches 17 on one or more of the receiving posts 14 or projections 15 positioned on the base 12. In this position, the cross-bar 20 is securely held adjacent the base to allow the pallet to be easily loaded with goods such as automobile seats. Once again, in an exemplary embodiment of the invention, the manual force "F" required to manually linearly displace the cross-bar 20 away from the notches 17 should be no more than approximately 15 kg.

In operation, the hold-down assembly 11 can be manually moved by an operator from the load position to the engaged position with a continuous or uninterrupted motion and with a pulling force of no more than approximately 15 kg. In other words, to move from the load position to the engaged position, an operator can pull against the force of the tension spring 26 to cause the cross-bar disengage from notches 17. With a continuous or uninterrupted motion, the operator can displace the cross-bar (lift and rotate) to the engaged position. Upon releasing the cross-bar, the tension mechanism 26 is adapted to pull the cross-bar 20 into contact with the goods or automobile seats positioned on the base 12 and to securely hold the goods or seats in place on the base 12 for transportation thereof.

Similarly, the hold-down assembly 11 can be manually moved by an operator from the engaged position to the load position by exerting force sufficient to overcome the tension mechanism with a continuous or uninterrupted motion and with a pulling force of no more than approximately 15 kg. In this respect, to move from the engaged position to the load position, an operator can pull against the force of the tension spring 26 to cause the cross-bar to linearly displace out away from the goods positioned on the base and with a continuous or uninterrupted motion, the operator can rotatably displace the cross-bar to the load position. Upon releasing the cross-bar, the tension mechanism 26 is adapted to pull the cross-bar 20 into contact, with the notches 17 of the receiving posts 14 or projections 15 of the base. In this position, the cross-bar 20 is securely held adjacent the base 12 to allow the pallet 10 to be easily loaded with goods such as automobile seats.

Having shown and described the preferred embodiments of the present invention, further adaptations of the adjustable hold-down assembly of the present invention as described herein can be accomplished by appropriate modifications by one of ordinary skill in the art without departing from the scope of the present invention. Several of these potential modifications and alternatives have been mentioned, and others will be apparent to those skilled in the art. For example, while exemplary embodiments of the system have been discussed for illustrative purposes, it should be understood that the elements described will be constantly updated and improved by technological advances. Accordingly, the scope of the present invention should be considered in terms of the following claims and is understood not to be limited to the details of structure, operation or process steps as shown and described in the specification and drawings.

We claim:

1. A shipping pallet comprising:

a base;

a hold-down assembly comprising a cross-bar moveably connected with two securing posts, said securing posts pivotally attached to the base;

a tension mechanism positioned between the cross-bar and one of the securing posts;

wherein the cross-bar is configured for rotational movement relative to said base and linear movement with respect to said securing posts.

2. The shipping pallet of claim 1, wherein the cross-bar further comprises substantially parallel engagement portions positioned substantially perpendicular to the cross-bar.

3. The shipping pallet of claim 2, wherein each engagement portion is adapted to slidably engage one of the securing posts.

4. The shipping pallet of claim 3, wherein said tension mechanism is positioned between one of the engagement portions of the cross-bar and one of the securing posts.

5. The shipping pallet of claim 2, further comprising a compression mechanism having a first end and a second end; the first end being pivotally attached to the base and the second end being pivotally attached to one of the engagement portions.

6. The shipping pallet of claim 5, wherein the compression mechanism provides a rotational force and a linear force on the engagement portion of the cross-bar.

7. The shipping pallet of claim 1, wherein the base further comprises one or more nests.

8. The shipping pallet of claim 1, wherein the base further comprises a one or more stacking posts.

9. The shipping pallet of claim 1, wherein the securing posts are pivotally attached to the base.

10. The shipping pallet of claim 1, further comprising one or more projections positioned around the periphery of base for selectively engaging a portion of the hold-down assembly when the hold-down assembly is in a load position.

11. A shipping pallet comprising a base; and an adjustable hold-down assembly attached to said base and having a load position and an engaged position, wherein the hold-down assembly can be moved from the load position to the engaged position with a continuous motion, wherein in the engaged position, the hold-down assembly asserts a resiliently biased force on goods on the base through a tension mechanism, a compression mechanism, or combinations thereof.

12. The shipping pallet of claim 11, wherein the hold-down assembly can be moved from the engaged position to the load position with a continuous motion.

13. The shipping pallet of claim 11, wherein in the load position, the cross-bar of the hold-down assembly engages a portion of the base.

14. The shipping pallet of claim 11, wherein in an engaged position, at least two forces act on the hold-down assembly.

15. The shipping pallet of claim 11, wherein the base further comprises one or more nests.

16. The shipping pallet of claim 11, wherein the base further comprises one or more stacking posts.

17. The shipping pallet of claim 11, wherein the hold-down assembly comprises a cross-bar and two substantially parallel engagement portions positioned substantially perpendicular to the cross-bar, the two substantially parallel engagement portions adapted to telescopingly engage a corresponding pair of securing posts positioned on the base.

18. The shipping pallet of claim 17, wherein the securing posts are pivotally attached to the base.

19. A method of unloading a shipping pallet, the method comprising the steps of:

providing a shipping pallet having a base and a hold-down assembly, the hold-down assembly having two or more positions including a load position and an engaged position, applying an outward linear force on the hold-down assembly, and rotating the hold-down assembly from the engaged position to the load position with a continuous motion, wherein in the engaged position, the hold-down assembly asserts a resiliently biased force on goods on the base through a tension mechanism, a compression mechanism or combinations thereof.

* * * * *